US010155243B2

(12) United States Patent
Mersmann

(10) Patent No.: US 10,155,243 B2
(45) Date of Patent: Dec. 18, 2018

(54) DISPENSING DEVICE FOR A FLUID

(71) Applicant: AERO PUMP GMBH, Hochheim/Main (DE)

(72) Inventor: Andreas Mersmann, Frankfurt am Main (DE)

(73) Assignee: AERO PUMP GMBH, Hochheim/Main (DE)

( * ) Notice: Subject to any disclaimer, the term of this patent is extended or adjusted under 35 U.S.C. 154(b) by 8 days.

(21) Appl. No.: 15/081,063

(22) Filed: Mar. 25, 2016

(65) Prior Publication Data

US 2016/0279663 A1 Sep. 29, 2016

(30) Foreign Application Priority Data

Mar. 26, 2015 (DE) ..... 10 2015 104 646

(51) Int. Cl.
*B05C 11/10* (2006.01)
*B05B 11/00* (2006.01)

(52) U.S. Cl.
CPC ..... *B05C 11/1028* (2013.01); *B05B 11/0067* (2013.01); *B05B 11/0072* (2013.01); *B05B 11/3016* (2013.01)

(58) Field of Classification Search
CPC ..... B05C 11/1028; B05B 11/0067; B05B 11/0072; B05B 11/3016; B05B 11/3014; B05B 11/00; B05B 11/3011; A61M 11/00; A61M 11/006; A61M 15/08
USPC ..... 222/321.6
See application file for complete search history.

(56) References Cited

U.S. PATENT DOCUMENTS 4,182,496 A * 1/1980 Burke ..... B05B 1/3436 222/380
5,558,258 A * 9/1996 Albini ..... B05B 1/3473 222/380
5,649,649 A * 7/1997 Marelli ..... B05B 11/3001 222/321.1
5,657,930 A * 8/1997 Battegazzore ..... B05B 11/0067 239/333

(Continued)

FOREIGN PATENT DOCUMENTS

DE 10 2008 027 146 12/2009
EP 0 686 433 12/1995

(Continued)

OTHER PUBLICATIONS

Europe Office Action/Search Report conducted in counterpart Europe Appln. No. 16 15 2682 (dated Jul. 25, 2016) (w/ partial English translation).

(Continued)

*Primary Examiner* — Benjamin R Shaw
(74) *Attorney, Agent, or Firm* — Greenblum & Bernstein, P.L.C.

(57) ABSTRACT

Dispensing device for a fluid and method for dispensing fluid from dispensing device. Dispensing device includes a fluid channel; a chamber arrangement including at least one sealing element; a dispensing opening; a valve element configured to be movably disposed within the chamber arrangement and to interact with the dispensing opening; and at least one sealing element, arranged within the chamber arrangement, that is configured to create a seal against the valve element during a first predetermined stroke of the valve element.

18 Claims, 5 Drawing Sheets

(56) References Cited

U.S. PATENT DOCUMENTS

| | | | | | |
|---|---|---|---|---|---|
| 5,842,616 | A * | 12/1998 | Ruscitti | B05B 11/0067 | 222/321.3 |
| 5,988,449 | A * | 11/1999 | Fuchs | B05B 11/0016 | 222/189.11 |
| 6,161,732 | A * | 12/2000 | Albini | B05B 11/0067 | 222/321.3 |
| 6,209,760 | B1 * | 4/2001 | Fuchs | B05B 11/0021 | 222/207 |
| 6,250,509 | B1 * | 6/2001 | Fuchs | B05B 11/0021 | 222/321.6 |
| 7,931,173 | B2 * | 4/2011 | Yuan | B05B 11/3032 | 222/207 |
| 2007/0221686 | A1 * | 9/2007 | Bae | A45D 34/02 | 222/409 |
| 2012/0018538 | A1 * | 1/2012 | Moretti | B05B 11/0067 | 239/461 |
| 2012/0126035 | A1 * | 5/2012 | Greiner-Perth | A61M 11/00 | 239/494 |

FOREIGN PATENT DOCUMENTS

| | | |
|---|---|---|
| EP | 0 688 608 | 12/1995 |
| WO | 99/04906 | 2/1999 |

OTHER PUBLICATIONS

German Office Action conducted in counterpart German Appln. No. 10 2015 104 646.6 (dated Sep. 22, 2015) (w/ English translation).

* cited by examiner

DISPENSING DEVICE FOR A FLUID

CROSS-REFERENCE TO RELATED APPLICATIONS

The present application claims priority under 35 U.S.C. § 119 of German Patent Application No. 10 2015 104 646.6, filed Mar. 26, 2015, the disclosure of which is expressly incorporated by reference herein in its entirety.

BACKGROUND

1. Field of the Invention

The invention relates to a dispensing device for a fluid with a fluid channel and a chamber arrangement in which a valve element that interacts with a dispensing opening is movably disposed.

2. Discussion of Background Information

Dispensing devices of this kind serve, for example, to dispense fluids that contain medical or cosmetic active substance solutions. The fluids are, for example, to be delivered to the nose, mouth or eyes of a user. For this purpose, the fluids are transported to the dispensing opening through the fluid channel and the chamber arrangement. The valve element movably disposed in the chamber arrangement serves to dispense a predetermined fluid quantity in a controlled manner.

For the purpose of dispensing a predetermined fluid quantity, the valve element interacts with the dispensing opening. In a closed state, the valve element can thereby seal the dispensing opening against an outflow of the fluid, for example. A stroke of the valve element places the element in an open state. In the open state, a fluid quantity can then pass out of the dispensing opening.

However, the following problem thereby results, particularly when the dispensing device is used as a "dropper": A merely small stroke of the valve element results in the fluid exiting the dispensing opening at high speed. This is detrimental to a controlled and predetermined dispensation of the fluid in the form of drops. In particular, a use of the dispensing device for eye drops would not come into consideration here.

The usage for medical fluids places an additional demand on the dispensing device. In this case, a contamination of the fluid by foreign matter between the valve element and the dispensing device must be avoided to the greatest possible extent. In particular, a contamination of this type cannot be allowed to continue into the fluid channel. As a result of this, the dispensing device would be unusable for the usage for medical fluids.

SUMMARY

Embodiments of the invention provide a dispensing device for a fluid, which enables a low-contamination dispensation of the fluid in the form of drops.

According to embodiments, a dispensing device of the type named at the outset includes a chamber arrangement that comprises at least one sealing element that creates a seal against the valve element during a first predetermined stroke of the valve element.

An actuation of the valve elements then does not result in the fluid already being able to exit the dispensing opening during a small stroke of the valve element. The fluid is thus also not accelerated in the small opening of the valve element. During the entire first predetermined stroke, the sealing element ensures that the fluid cannot pass through the valve element. Accordingly, as a result of the first predetermined stroke, a certain fluid quantity collects in the fluid channel and chamber arrangement. It can also be avoided that contamination will continue past the valve element into the chamber arrangement or the fluid channel.

It is thereby preferred that the sealing element closes a fluid path from the chamber arrangement to the dispensing opening during the first predetermined stroke. The fluid channel opens into the chamber arrangement. The path of the fluid through the fluid channel continues in the fluid path in the chamber arrangement. This fluid path is interrupted by the sealing element during the first predetermined stroke of the valve element. The interruption of the fluid path causes the fluid to be held in the chamber arrangement. There results a collection of a certain fluid quantity in the chamber arrangement, which quantity cannot, however, proceed to the dispensing opening.

For this purpose, it is advantageous that the sealing element unblocks the fluid path during a stroke (or a further stroke) of the valve element that is larger than (and a continuation of) the first predetermined stroke. After a certain fluid quantity has collected in the chamber arrangement, the stroke of the valve element will exceed the first predetermined stroke. As the fluid path for the fluid is unblocked by the sealing element when the first predetermined stroke of the valve element is exceeded, the sealing element no longer creates a seal against the valve element, whereby the fluid path for the fluid is unblocked. The fluid can then be transported to the dispensing opening via the fluid path. The fluid quantity can be dispensed in the form of a drop.

It is preferred that the valve element comprises a space, in particular at least one groove, which forms a part of the fluid path. The fluid is transported from the chamber arrangement to the dispensing opening on the fluid path along the valve element. However, the space is only unblocked after the stroke of the valve element has exceeded the first predetermined stroke. In this manner, it is ensured that the fluid does not need to pass through a narrow fluid path. An unintended acceleration of the fluid as it passes through the valve element can thus be avoided. A controlled dispensation of the fluid is rendered possible. An uncontrolled spurting of the fluid out of the dispensing opening is avoided. The space, which forms a part of the fluid path, can in particular be embodied as at least one groove. A controlled transport of the fluid is possible. An ingress of larger foreign matter particles can be avoided. A contamination of the fluid path can thus be minimized.

It is preferred that the chamber arrangement comprises a valve chamber and a nozzle chamber, wherein the sealing element seals the nozzle chamber against the valve chamber. A spatial division of the chamber arrangement is achieved. In the valve chamber, the collection of fluid occurs during the first predetermined stroke of the valve element. Because of the sealing element, the fluid cannot exit the valve chamber during the first predetermined stroke. However, once the stroke of the valve element exceeds the first predetermined stroke, the fluid path is unblocked. The fluid can be transported from the valve chamber into the nozzle chamber. By the spatial separation of the valve chamber and the nozzle chamber, an additional barrier is created against the ingress of foreign matter. The contamination of the dispensing device can be minimized.

Here, it is preferred that a valve seat, in which the valve element is movably disposed and which comprises the sealing element, is disposed between the valve chamber and the nozzle chamber. On the one hand, the valve seat serves to spatially separate the valve chamber and the nozzle chamber. On the other hand, it serves to accommodate the valve element. The valve seat then advantageously also comprises the sealing element; this element can, for example, be disposed between the valve element and valve seat. It is possible to embody the valve seat and the sealing element in a single piece. The fluid path is disposed between the sealing element and/or valve seat and the valve element.

It is likewise preferred that the fluid path opens into the nozzle chamber, which includes the dispensing opening. The fluid is transported via the fluid path. The fluid quantity that has collected in the nozzle chamber thereby first passes through the space of the valve element. After the valve element has been passed through in this manner, the transport of the fluid continues into the nozzle chamber via the fluid path. The nozzle chamber thereby has a larger volume than the space. During the transport of the fluid from the valve chamber into the space, the fluid has been accelerated. The volume of the space is smaller than the volume of the valve chamber. When the fluid flows from the space into the nozzle chamber, the fluid is decelerated by expanding into the volume of the nozzle chamber. The fluid quantity reaching the nozzle chamber in this manner can then exit the dispensing opening in a controlled manner. For this purpose, the nozzle chamber comprises the dispensing opening. A dispensation of the fluid in the form of drops is rendered possible.

It is also preferred that the sealing element is embodied as at least one sealing lip and bears against the valve element during the first predetermined stroke. A fluid-tight contact between the sealing element and the valve element occurs. A reliable seal between the sealing element and the valve element and between the valve chamber and the nozzle chamber is achieved. During a stroke of the valve element that is larger than the first predetermined stroke, the contact of the sealing element with the valve element ends. The space enters between the sealing element and the valve element. A pass-through opening is thus opened between the valve chamber and the nozzle chamber. The fluid quantity collected in the valve chamber can pass through the sealing element and enter the space. The fluid is transported from the valve chamber into the nozzle chamber and ultimately to the dispensing opening.

Still further, it is preferred that, during a second predetermined stroke, the valve element seals the dispensing opening. In particular, during the second predetermined stroke, the sealing element keeps the fluid path from the chamber arrangement to the dispensing opening closed. Thus, during this second predetermined stroke, the valve element interacts with the dispensing opening in such a manner that it seals the opening in a closed state. Thus, the valve element is at least partially accommodated in the nozzle chamber. In this closed state, the ingress of foreign matter into the nozzle chamber can thus be avoided. A contamination of the dispensing device is likewise avoided. During a stroke (or further stroke) of the valve element that is larger than (and a continuation of) the second predetermined stroke, the valve element unblocks the dispensing opening so that fluid located in the nozzle chamber can exit through the dispensing opening. However, in this state, it is preferred that an exiting of the fluid through the dispensing opening is still to be avoided. In this manner, the sealing element closes the fluid path from the chamber arrangement to the dispensing opening during the second predetermined stroke so that no fluid can reach the nozzle chamber from the valve chamber. However, once the stroke of the valve element has exceeded the first predetermined stroke, the sealing element unblocks the fluid path between the valve chamber and the nozzle chamber so that a controlled dispensation of the fluid in the form of drops is then possible.

Here, it is preferred that the first predetermined stroke constitutes a multiple of the second predetermined stroke. In this manner it is on the one hand achieved that a fluid quantity sufficient to form drops can collect in the valve chamber. On the other hand, it is ensured that the dispensing opening is completely unblocked by the valve element. The transport of the fluid through a narrow opening between the valve element and the dispensing element can thus be avoided. An acceleration of the fluid during the dispensing is avoided. A dispensation of the fluid in the form of drops is rendered possible.

Embodiments are directed to a dispensing device for a fluid that include a fluid channel; a chamber arrangement including at least one sealing element; a dispensing opening; a valve element configured to be movably disposed within the chamber arrangement and to interact with the dispensing opening; and at least one sealing element, arranged within the chamber arrangement, that is configured to create a seal against the valve element during a first predetermined stroke of the valve element.

According to embodiments of the invention, the at least one sealing element can be configured so that, during the first predetermined stroke, a fluid path from the chamber arrangement to the dispensing opening can be closed. In a further stroke of the valve element, which exceeds the first predetermined stroke, the fluid path can be unblocked by the at least one sealing element. Further, the valve element may include a space, which forms a part of the fluid path, and the space can include at least one groove.

In accordance with other embodiments, the chamber arrangement may further include a valve chamber and a nozzle chamber, and the at least one sealing element can be configured to seal the nozzle chamber against the valve chamber. Further, the dispensing device can include a valve seat, in which the valve element can be movably disposed and which may include the at least one sealing element. The valve seat may be arranged between the valve chamber and the nozzle chamber. Moreover, a fluid path, which is selectively blockable by the at least one sealing element, can be opened into the nozzle chamber, in which the dispensing opening is arranged.

According to still other embodiments, the at least one sealing element can be formed as at least one sealing lip that is configured to bear against the valve element during the first predetermined stroke.

Still further, the valve element can be configured so that, during a second predetermined stroke of the valve element, the dispensing opening may be sealed and the fluid path from the chamber arrangement to the dispensing opening may be closed. The first predetermined stroke can constitute a multiple of the second predetermined stroke. Further, the first predetermined stroke can include the second first predetermined stroke.

In embodiments, the dispensing device may further include a liner channel extending between the fluid channel and the chamber arrangement. Further, a crown can be arranged at a transition from the liner channel to the chamber arrangement.

Embodiments of the invention can be directed to a method of dispensing a fluid from the above-described dispensing device. The method includes guiding the fluid from the fluid channel to the chamber arrangement, whereby the fluid in the chamber arrangement displaces the valve element relative to the at least one sealing element; and during the first predetermined stroke, maintaining a seal of the at least one sealing element against the valve element.

In accordance with still yet other embodiments of the present invention, during a second predetermined stroke of the valve element, which is part of the first predetermined stroke of the valve element, the method may further include blocking the dispensing opening. Further, during a stroke of the valve element that exceeds the second predetermined stroke, the method can include opening the dispensing opening. Moreover, in a stroke of the valve element that exceeds the second predetermined stroke but does not exceed the first predetermined stroke, the method may further include blocking a flow path of the fluid from the chamber arrangement to the dispensing opening. Still further, in a stroke of the valve element that exceeds the first predetermined stroke, the method may further include opening a flow path of the fluid from the chamber arrangement to the dispensing opening.

Embodiments of the invention are directed to a method of dispensing a fluid. The method includes guiding a fluid from the fluid supply to a valve chamber, whereby the fluid in the valve chamber displaces the valve element relative to the at least one sealing element; during the first predetermined stroke of the valve element, maintaining a seal between the valve chamber and a nozzle chamber; during a second predetermined stroke of the valve element, which is a part of the first predetermined stroke, blocking a dispensing opening in the nozzle chamber with at least a part of the valve element; during a stroke of the valve element that exceeds the second predetermined stroke but not the first predetermined stroke, unblocking the dispensing opening in the nozzle chamber while preventing a flow of the fluid from the valve chamber to the unblocked dispensing opening; and during a stroke of the valve element that exceeds the first predetermined stroke, opening a flow of the fluid from the valve chamber to the nozzle chamber so that the fluid is dispensed through the unblocked dispensing opening.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
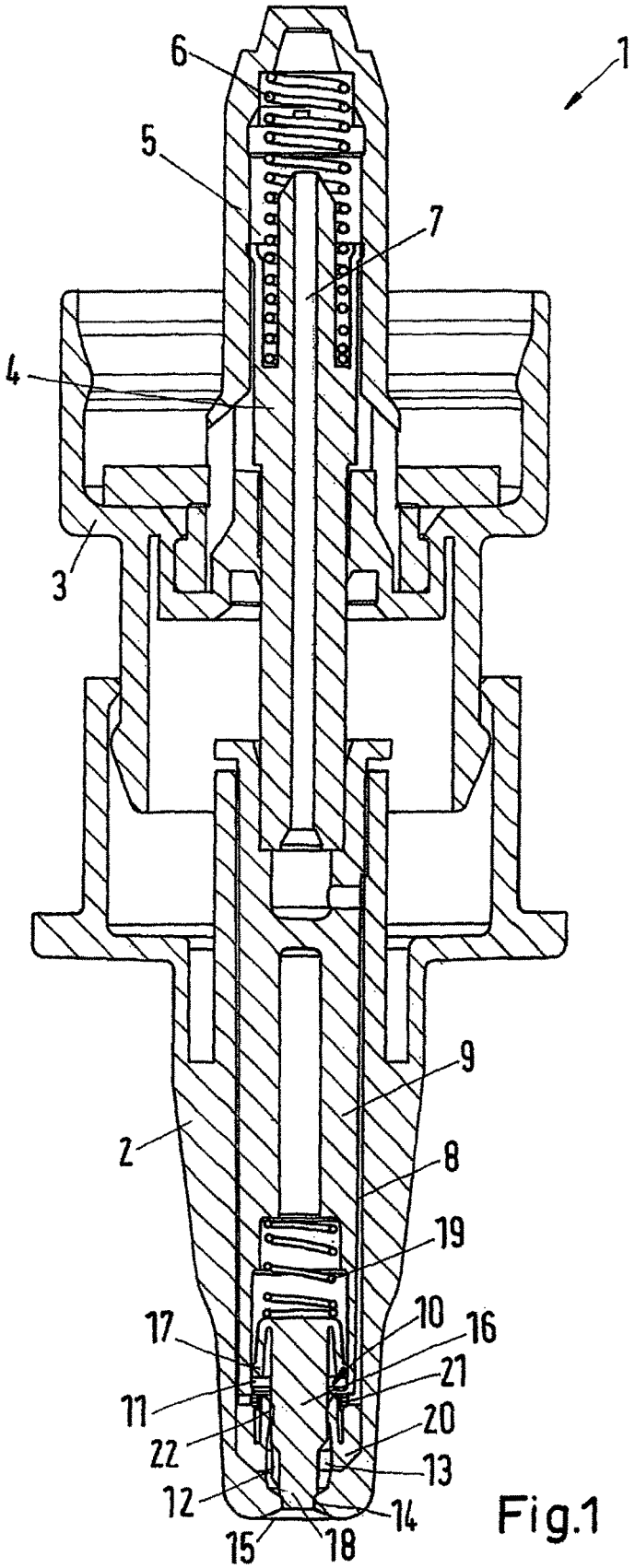
FIG. 1 shows a dispensing device for a fluid with a valve element in a closed state.

FIG. 1 shows a dispensing device 1 for a fluid. Dispensing device 1 comprises a head base part 2 that is disposed on a snap-on element 3. A cone 4 extends from head base part 2 into an enclosure 5 through the snap-on element 3 in an axial direction. Cone 4 interacts with an enclosure spring 6 in enclosure 5. Cone 4 comprises a fluid channel 7. Fluid channel 7 extends towards head base part 2 in the axial direction.

Fluid channel 7 continues into a liner channel 8 in head base part 2. This liner channel 8 is disposed between head base part 2 and a liner 9.

Liner channel 8 opens into a chamber arrangement 10. This chamber arrangement 10 comprises a valve chamber 11. A space 12 thereby frees a fluid path from valve chamber 11 to a nozzle chamber 13. Nozzle chamber 13 comprises a dispensing opening 14. Dispensing opening 14 is embodied in the form of a calotte 15.

A valve element 16 is disposed in the chamber arrangement 10. This element comprises a first sealing lip 17 in valve chamber 11. At an end of valve element 16 opposite of first sealing lip 17, valve element 16 is embodied in the shape of a cylinder 18. Valve chamber 11 is divided into two regions by first sealing lip 17. The fluid path of liner channel 8 continues into a first region of valve chamber 11. This first region of valve chamber 11 is spatially separated from a second region of valve chamber 11 by first sealing lip 17. The second region of the valve chamber 11 comprises a head spring 19.

Between valve chamber 11 and nozzle chamber 13, a valve seat 20 is disposed. This valve seat 20 comprises at least one crown 21. Crown 21 is disposed at the transition from liner channel 8 to valve chamber 11. Furthermore, valve seat 20 comprises a sealing element 22.

Figure 2:
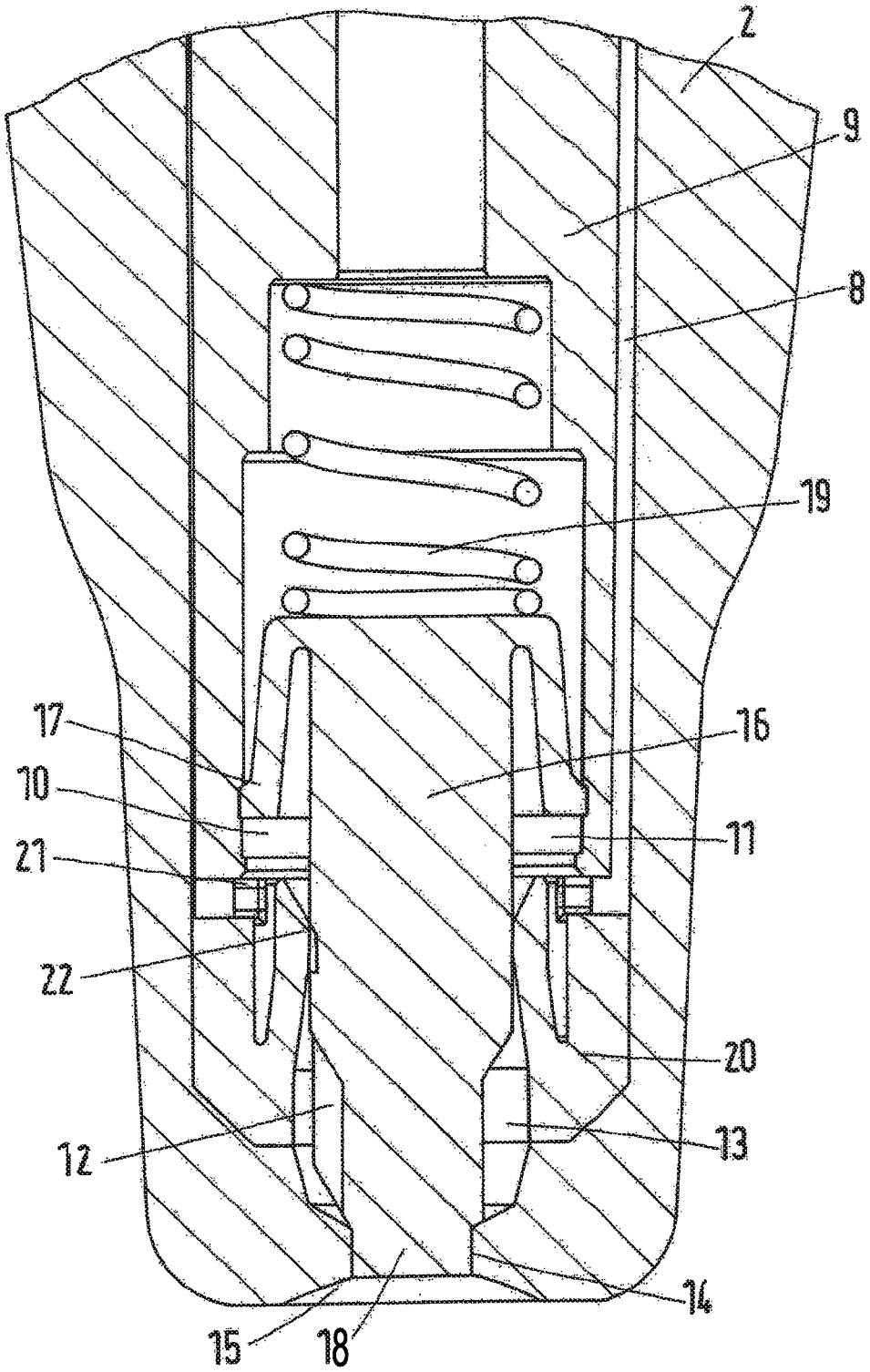
FIG. 2 shows a detailed view of a chamber arrangement of the dispensing device for a fluid with the valve element in the closed state.
Figure 3:
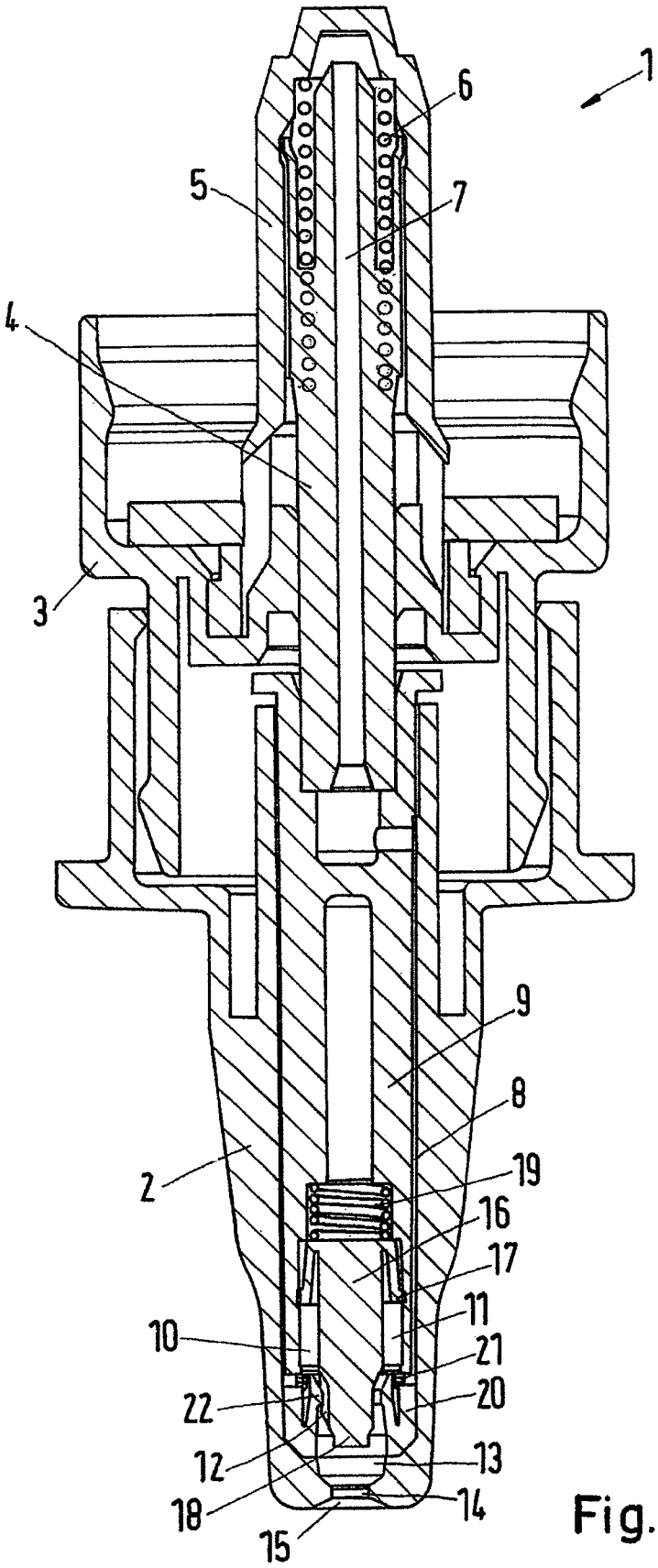
FIG. 3 shows a dispensing device for a fluid with the valve element in an open state.

The embodiment of the dispensing device 1 described above is illustrated in FIGS. 1 through 4. Identical features are thereby provided with the same reference numerals. FIG. 1 thereby illustrates a state of the dispensing device 1 in which the valve element 16 is disposed in a closed state. FIG. 3, on the other hand, shows the same dispensing device 1, in which the valve element 16 is disposed in an open state.

Figure 4:
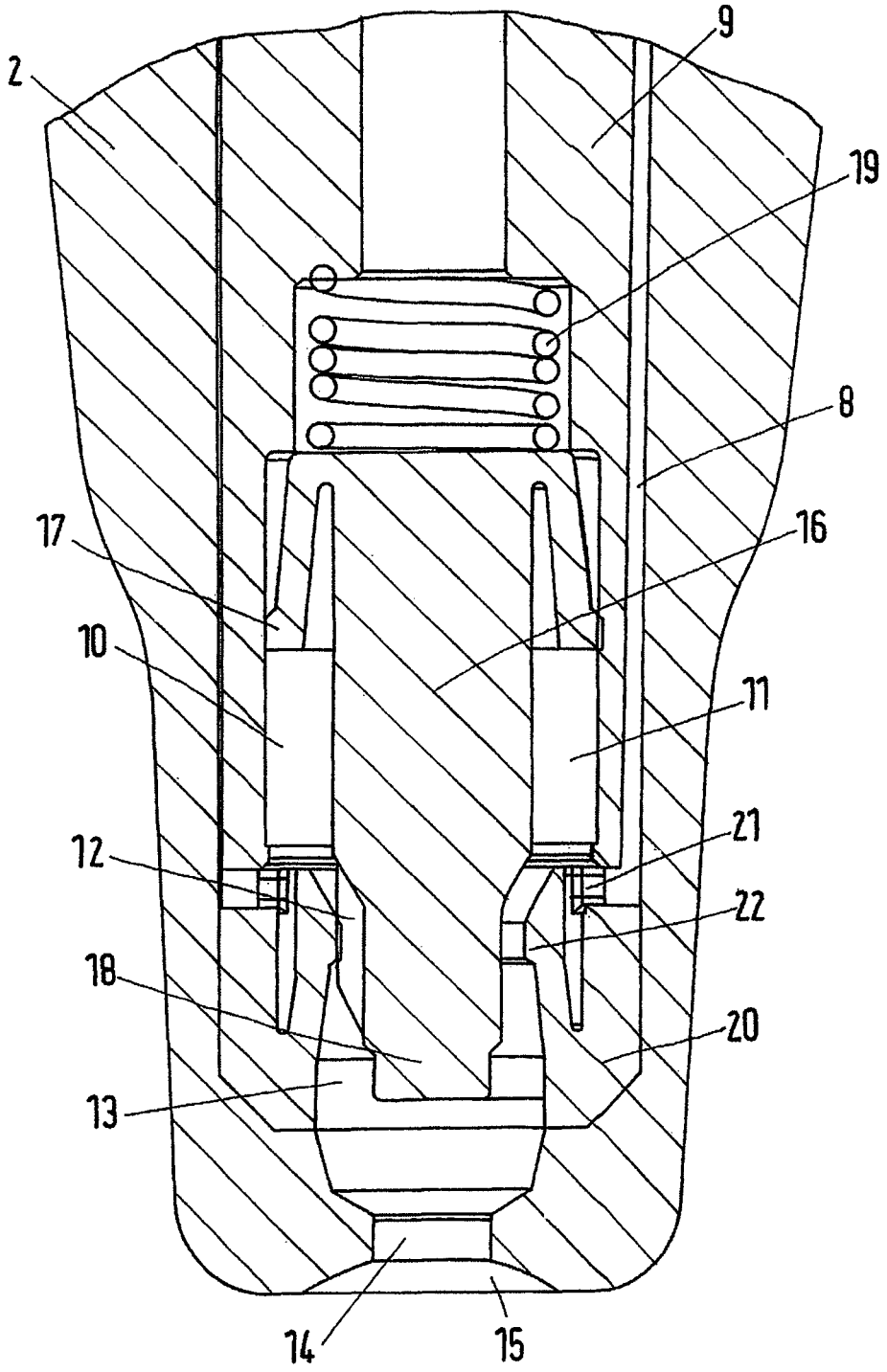
FIG. 4 shows a detailed view of the chamber arrangement of the dispensing device for a fluid with the valve element in an open state.

A functional principle of the dispensing device 1 will now be explained in greater detail with the aid of FIGS. 2 and 4.

To dispense the fluid, a user moves head base part 2 towards snap-on element 3 in the axial direction. As a result, cone 4 is moved against the spring force of enclosure spring 6 in the interior of enclosure 5. The volume in a pump chamber of enclosure 5 thereby decreases. The pump chamber is formed by the space surrounding enclosure spring 6. The transported fluid quantity is determined by a stroke of cone 4 inside the pump chamber. The dosage of a predetermined fluid quantity is hereby rendered possible. By the resulting overpressure, the fluid is displaced into fluid channel 7 from the pump chamber. The fluid is transported along fluid channel 7 in an axial direction. The transport of the fluid continues in or along liner 9 through liner channel 8. At an axial end of liner channel 8, the fluid ultimately passes through crown 21 and enters valve chamber 11.

A certain fluid collection in the valve chamber 11 occurs. As more fluid collects in the valve chamber 11, the pressure of the fluid on valve element 16 increases. More particularly, the first region of valve chamber 11, i.e., above valve element 16, can thereby be sealed against the second region of the valve chamber 11, i.e., below valve element 16, in which head spring 19 is disposed, by first sealing lip 17. Furthermore, valve chamber 11 is sealed against nozzle chamber 13 by sealing element 22. Thus, the fluid collecting in valve chamber 11 displaces valve element 16 against the spring force of head spring 19.

Before the displacement of valve element 16 against the spring force of head spring 19 takes place, cylinder 18 seals outlet opening 14. This seal is achieved, for example, by a positive fit. The possibility of a contamination of nozzle chamber 13 can be avoided.

The fluid entering valve chamber 11 displaces valve element 16 against spring force of head spring 19, resulting in a stroke of valve element 16. After a further stroke, e.g., a second predetermined stroke, of valve element 16, cylinder 18 unblocks dispensing opening 14. However, at this point, sealing element 22 still bears against valve element 16 in a fluid-tight manner so that the fluid located in valve chamber 11 cannot enter space 12. Space 12 can be embodied, as in the exemplary embodiment, as a groove in valve element 16. A still further stroke of valve element 16 continues until sealing element 22 reaches space 12, whereby valve element 16 in total can be understood to have traveled a first predetermined stroke. Therefore, during the first predetermined stroke, sealing element 22 creates and maintains a seal against valve element 16.

Figure 5:
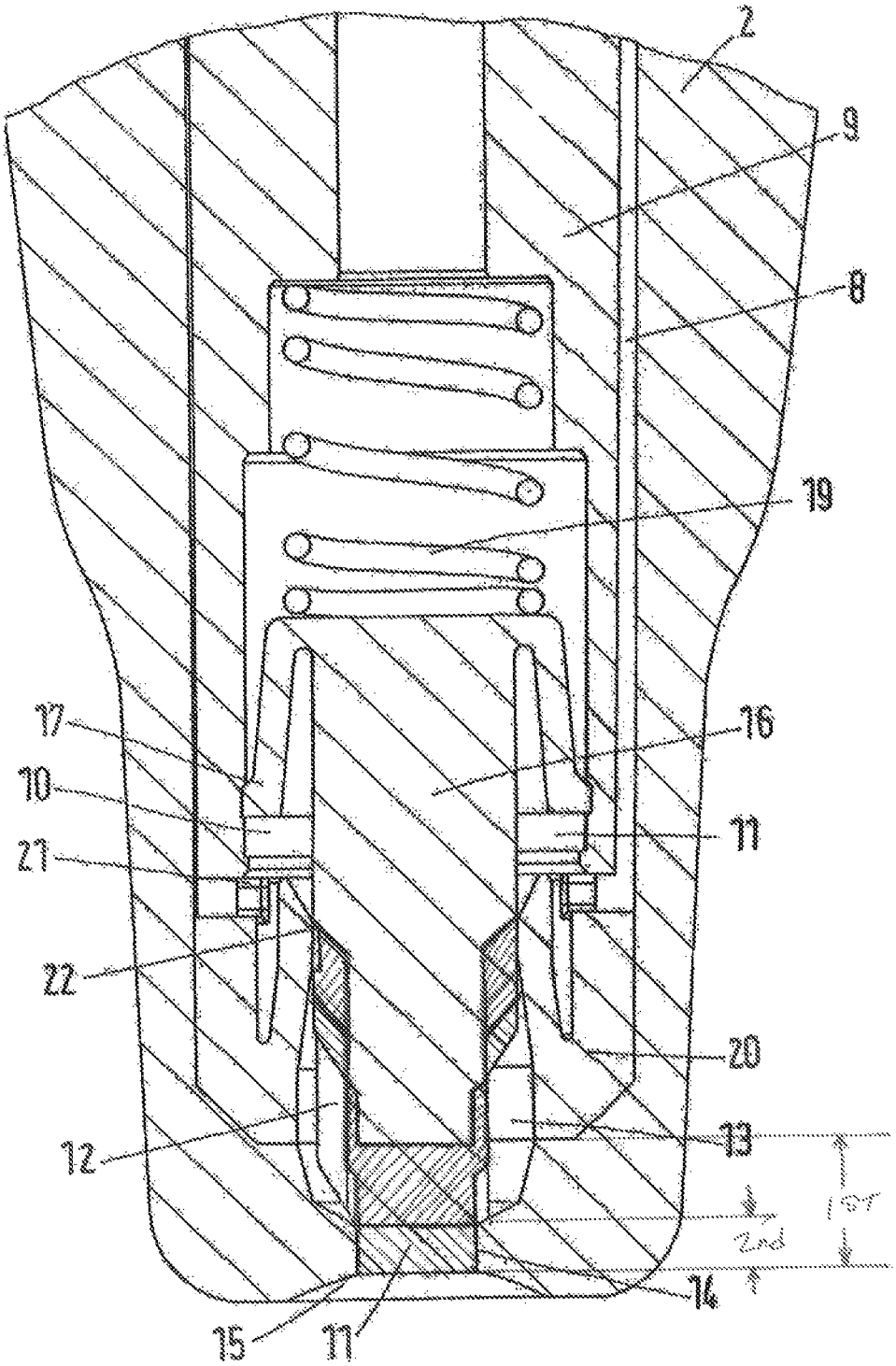
FIG. 5 shows displacement of a portion of the valve element for the first and second predetermined strokes.

The stroke of valve element 16 can be continued so as to exceed the first predetermined stroke, whereby an overlap of sealing element 22 with space 12 occurs. In this arrangement, sealing element 22 then unblocks a fluid path from valve chamber 11 to nozzle chamber 13 via space 12. The fluid located in valve chamber 11 can enter space 12 and can then be transported through space 12 into nozzle chamber 13. In the exemplary embodiment shown, the first predetermined stroke is embodied as a multiple of the second predetermined stroke. In this manner, it is achieved that cylinder 18 has completely unblocked dispensing opening 14 after a stroke that is larger than the first predetermined stroke. FIG. 5 shows examples of the extent of the displacement of a part of valve element 16 during the first and second predetermined strokes.

The volume of valve chamber 11 is larger than the volume of space 12. As a result, the fluid is accelerated upon entering space 12. This acceleration is undesired, since a controlled dispensation of the fluid in the form of drops is intended. For this reason, nozzle chamber 13, which has a larger volume than space 12, is disposed after space 12 in the transport direction of the fluid in the fluid path. The fluid accelerated in space 12 can thus expand in nozzle chamber 13, resulting in the fluid being decelerated. Nozzle chamber 13 then comprises dispensing opening 14. The fluid can pass out of dispensing opening 14 along calotte 15 in the form of drops.

On the one hand, the dispensation of the fluid in the form of drops by dispensing device 1 is hereby rendered possible. On the other hand, a contamination of dispensing device 1 with foreign matter can be avoided to a great extent.

The contamination of the dispensing device 1 is avoided on the one hand by the sealing of the dispensing opening 14 by cylinder 18 in a closed state of valve element 16. The spatial separation of nozzle chamber 13 and valve chamber 11 by valve seat 20 also serves this purpose. Sealing element 22 prevents an ingress of foreign matter from nozzle chamber 13 into valve chamber 11 during the first predetermined stroke, i.e., during a stroke that is smaller than the first predetermined stroke. During a further stroke, which is larger than and a continuation of the first predetermined stroke, sealing element 22 unblocks the fluid path so that fluid from valve chamber 11 enters space 12 and, subsequently, nozzle chamber 13. Foreign matter potentially located in nozzle chamber 13 is thus washed out. This matter cannot reach valve chamber 11 through space 12 against the fluid flow. A contamination of dispensing device 1 can thus be avoided to a large extent.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular elements, materials and embodiments, the present invention is not intended to be limited to the particulars disclosed herein; rather, the present invention extends to all functionally equivalent structures, methods and uses, such as are within the scope of the appended claims.

What is claimed:

1. A dispensing device for a fluid comprising:

a fluid channel;

a chamber arrangement comprising a valve chamber and a nozzle chamber;

a dispensing opening;

a valve element configured to be movably disposed within the chamber arrangement and to interact with the dispensing opening, the valve element including a space with a predefined volume that is less than a volume of the valve chamber and that is less than a volume of the nozzle chamber; and at least one sealing element, arranged within the chamber arrangement, that is configured to create a seal against the valve element during a first predetermined stroke of the valve element, wherein the valve element is configured so that, during a second predetermined stroke of the valve element, the dispensing opening is sealed and the fluid path from the chamber arrangement to the dispensing opening is closed via a positive fit with the valve element and, at a stroke greater than the second predetermined stroke, the valve element unseals the dispensing opening, wherein the at least one sealing element is configured so that, during the first predetermined stroke, and following the second predetermined stroke, a fluid path from the chamber arrangement to the dispensing opening is closed, and wherein, with reference to a fluid flow direction, the nozzle chamber is arranged downstream of the space.

2. The dispensing device according to claim 1, wherein, in a further stroke of the valve element, which exceeds the first predetermined stroke, the fluid path is unblocked by the at least one sealing element.

3. The dispensing device according to claim 1, wherein the space forms a part of the fluid path.

4. The dispensing device according to claim 3, wherein the space comprises at least one groove.

5. The dispensing device according to claim 1, wherein the at least one sealing element is configured to seal the nozzle chamber against the valve chamber.

6. The dispensing device according to claim 5, further comprising a valve seat, in which the valve element is movably disposed and which includes the at least one sealing element, the valve seat being arranged between the valve chamber and the nozzle chamber.

7. The dispensing device according to claim 6, wherein a fluid path, which is selectively blockable by the at least one sealing element, opens into the nozzle chamber, in which the dispensing opening is arranged.

8. The dispensing device according to claim 1, wherein the at least one sealing element is formed as at least one sealing lip that is configured to bear against the valve element during the first predetermined stroke.

9. The dispensing device according to claim 1, wherein the first predetermined stroke constitutes a multiple of the second predetermined stroke.

10. The dispensing device according to claim 8, wherein the first predetermined stroke comprises the second predetermined stroke.

11. The dispensing device according to claim 1, further comprising a liner channel extending between the fluid channel and the chamber arrangement.

12. The dispensing device according to claim 11, further comprising a crown arranged at a transition from the liner channel to the chamber arrangement.

13. A method of dispensing a fluid from the dispensing device according to claim 1, comprising:

guiding the fluid from the fluid channel to the chamber arrangement, whereby the fluid in the chamber arrangement displaces the valve element relative to the at least one sealing element; and during the first predetermined stroke, maintaining a seal of the at least one sealing element against the valve element, wherein, during the first predetermined stroke and, at a stroke greater than the second predetermined stroke, the valve element unblocks the dispensing opening.

14. The method according to claim 13, wherein during a second predetermined stroke of the valve element, which is part of the first predetermined stroke of the valve element, the method further comprises blocking the dispensing opening.

15. The method according to claim 14, wherein during a stroke of the valve element that exceeds the second predetermined stroke, the method comprises opening the dispensing opening.

16. The method according to claim 15, wherein, in a stroke of the valve element that exceeds the second predetermined stroke but does not exceed the first predetermined stroke, the method further comprises blocking a flow path of the fluid from the chamber arrangement to the dispensing opening.

17. The method according to claim 15, wherein, in a stroke of the valve element that exceeds the first predetermined stroke, the further comprises opening a flow path of the fluid from the chamber arrangement to the dispensing opening.

18. A method of dispensing a fluid, comprising:

guiding a fluid from a fluid supply to a valve chamber, whereby the fluid in the valve chamber displaces a valve element relative to at least one sealing element;

during a first predetermined stroke of the valve element, maintaining a seal between the valve chamber a nozzle chamber;

during a second predetermined stroke of the valve element, which is a part of the first predetermined stroke, blocking a dispensing opening in the nozzle chamber with at least a part of the valve element;

during a stroke of the valve element that exceeds the second predetermined stroke but not the first predetermined stroke, unblocking the dispensing opening in the nozzle chamber while preventing a flow of the fluid from the valve chamber to the unblocked dispensing opening; and during a stroke of the valve element that exceeds the first predetermined stroke, opening a flow of the fluid from the valve chamber to the nozzle chamber via a space in the valve element having a volume that is less than a volume of nozzle chamber so that the fluid is dispensed through the unblocked dispensing opening.

* * * * *